United States Patent [19]

Dellassio et al.

[11] Patent Number: 4,688,722

[45] Date of Patent: Aug. 25, 1987

[54] NOZZLE ASSEMBLY FOR PLASMA SPRAY GUN

[75] Inventors: Anthony D. Dellassio, Howard Beach; Daniel Yakovlevitch, Bayside; Richard T. Smyth, Huntington, all of N.Y.

[73] Assignee: The Perkin-Elmer Corporation, Norwalk, Conn.

[21] Appl. No.: 646,734

[22] Filed: Sep. 4, 1984

[51] Int. Cl.[4] ..... B05B 1/24; B05B 15/00; B05B 1/00; A62C 31/02

[52] U.S. Cl. ..... 239/81; 239/132.3; 239/390; 239/397; 239/600

[58] Field of Search ..... 239/13, 79, 81, 83, 239/84, 85, 132.3, 390, 397, 600

[56] References Cited

U.S. PATENT DOCUMENTS

| | | | |
|---|---|---|---|
| 2,960,594 | 11/1960 | Thorpe | 239/79 X |
| 3,106,633 | 10/1963 | Skinner et al. | 219/75 |
| 3,112,072 | 11/1963 | Malone | 239/79 |
| 3,145,287 | 8/1964 | Siebein et al. | 219/75 |
| 3,756,511 | 9/1973 | Shinroku et al. | 239/132.3 |
| 4,127,760 | 11/1978 | Meyer et al. | 219/121 PP X |
| 4,169,560 | 10/1979 | Vöhringer | 239/600 X |
| 4,430,546 | 2/1984 | Irons et al. | 219/121 PY |
| 4,445,021 | 4/1984 | Irons et al. | 239/125 X |

*Primary Examiner*—Joseph F. Peters, Jr.
*Assistant Examiner*—Patrick N. Burkhart
*Attorney, Agent, or Firm*—H. S. Ingham; F. L. Masselle; E. T. Grimes

[57] ABSTRACT

A nozzle assembly for a plasma gun is disclosed, containing an annular coolant passage for extended nozzle life, providing for convenient and low cost replacement of the nozzle member and for improved gun operation. To form the assembly a jacket is disposed about the nozzle member in a predetermined coaxial position. An inner surface of the jacket cooperates with the cylindrical exteriority of the nozzle to define an annular coolant passage. The jacket and the nozzle are in relative slidable relationship such that the nozzle member is removable and replaceable forwardly with respect to the jacket, forwardly being in respect to the direction of the plasma flame. A flange at the forward end of the nozzle member retains the nozzle member from sliding rearward from the predetermined position with respect to the jacket. The jacket has coolant ports for the coolant connecting with the annular passage. A seal such as an O-ring is interposed between the rear portion of the nozzle and the jacket.

9 Claims, 4 Drawing Figures

NOZZLE ASSEMBLY FOR PLASMA SPRAY GUN

This invention relates to a plasma spray gun and particularly to a nozzle assembly therefor which has an efficient nozzle cooling system and a readily replaceable nozzle.

BACKGROUND OF THE INVENTION

Flame spraying involves the heat softening of a heat fusible material, such as a metal or ceramic, and propelling the softened material in particulate form against a surface which is to be coated. The heated particles strike the surface and bond thereto. A conventional flame spray gun is used for the purpose of both heating and propelling the particles. In one type of flame spray gun, the heat fusible material is supplied to the gun in powder form. Such powders are typically comprised of small particles, e.g., below 100 mesh U.S. standard screen size to about 5 microns.

In typical plasma flame spraying systems for spraying powder, an electric arc is created between a water cooled nozzle (anode) and a centrally located cathode. An inert gas passes through the electric arc and is excited thereby to temperatures of up to 30,000° F. The plasma of at least partially ionized gas issuing from the nozzle resembles an open oxy-acetylene flame. A typical plasma flame spray gun is described in U.S. Pat. No. 3,145,287.

The electric arc of such plasma spray guns, being as intense as it is, causes nozzle deterioration and ultimate failure. One cause for such deterioration is the fact that the arc itself strikes the nozzle/anode at a point, thereby causing instantaneous local melting and vaporizing of the nozzle surface. Deterioration is also caused by overheating the nozzle to the melting point so that part of the nozzle material flows to another location which may eventually cause the nozzle to become plugged.

There are varying degrees and rates associated with each cause for nozzle deterioration. Experience has shown that wall erosion, ultimately causing the coolant to burst through the nozzle wall, is another cause of nozzle failure. When the jacket bursts, coolant water is released into the arc region, resulting in a locally intense electric arc, causing parts to melt. Once a meltdown has occurred, gun repair can be very costly. The nozzle deterioration and failure problem is particularly severe at high power levels.

In seeking to overcome this problem, plasma flame spray guns have been designed with easily changed water cooled nozzles. During operation, water coolant is forced through passages in the nozzle to cool the nozzle walls. Even so, gradual, or sometimes rapid, deterioration occurs and, as a precaution against failure, the nozzles are usually replaced after a given number of hours of service. This practice of replacing the nozzle periodically, however, is quite costly because the interchangeable nozzles are fairly expensive and many nozzles with considerable life remaining are thereby discarded.

U.S. Pat. No. 4,430,546 describes a plasma spray gun nozzle with a thin wall and an annular coolant passage to provide extended life. Specific dimensions of the wall and passage are disclosed to assure maximum nozzle life. That development substantially advanced the life expectancy of nozzles, especially in heavy duty plasma guns. However, the construction of the nozzle incorporating the coolant passage, as taught therein, is not conducive to achieving low cost for parts, particularly with respect to nozzle replacement. In particular a one-piece unitary nozzle containing cooling passages is expensive. An alternative method suggested in the above-named patent is a part of "clam shell" parts that fit about the nozzle, but these are not easy to use and can allow leaking of the coolant.

Another form of nozzle insert in an arc torch device containing an annular cooling passage is shown in U.S. Pat. Ser. No. 3,106,633. However, before the nozzle can be removed replaced, two other components must be removed including the part providing the outer wall of the annular passage, which must be threaded out of the arc torch device.

Therefore, it is an objective of the present invention to provide for a plasma spray gun an improved nozzle assembly containing a coolant passage.

It is a further object to provide a novel nozzle assembly which contains a coolant passage for extended nozzle life in a plasma spray gun and which allows convenient and low cost replacement of the nozzle.

It is yet a further object to provide an improved plasma spray gun including a nozzle assembly which contains a coolant passage and allows convenient and low cost replacement of the nozzle.

It is another object to provide a plasma spray gun including a nozzle assembly with a coolant passage and having improved operation and low cost maintenance.

BRIEF DESCRIPTION OF THE INVENTION

The foregoing and other objects of the present invention are achieved by a nozzle assembly for a plasma gun in which the assembly is comprised of a generally tubular nozzle member and a jacket of generally hollow cylindrical configuration disposed in predetermined coaxial position about the nozzle member. An inside surface of the jacket cooperates with the cylindrical exteriority of the nozzle member to define an annular coolant passage. The jacket and nozzle member are in relative slideable relationship for removal and replacement of the nozzle member forwardly with respect to the jacket, forwardly i.e. in the direction of the plasma flame. A flange at the forward end of the nozzle member limits the relative axial movement rearwardly into the jacket beyond a predetermined position. The jacket has respective coolant ports adjacent the flame and near the distal end, the ports connecting with respective annular passages. A replaceable seal such as an O-ring is interposed between the corresponding reward portions of the nozzle member and the jacket to retain coolant. Additional seals cooperating with the body of the plasma gun are located, respectively, at the flange, at the central section of the jacket between the respective coolant ports, and near the rear section of the jacket.

BRIEF DESCRIPTION OF THE DRAWINGS

The drawings illustrate various parts of a plasma gun according to the present invention wherein.

DETAILED DESCRIPTION OF THE INVENTION

Figure 1:
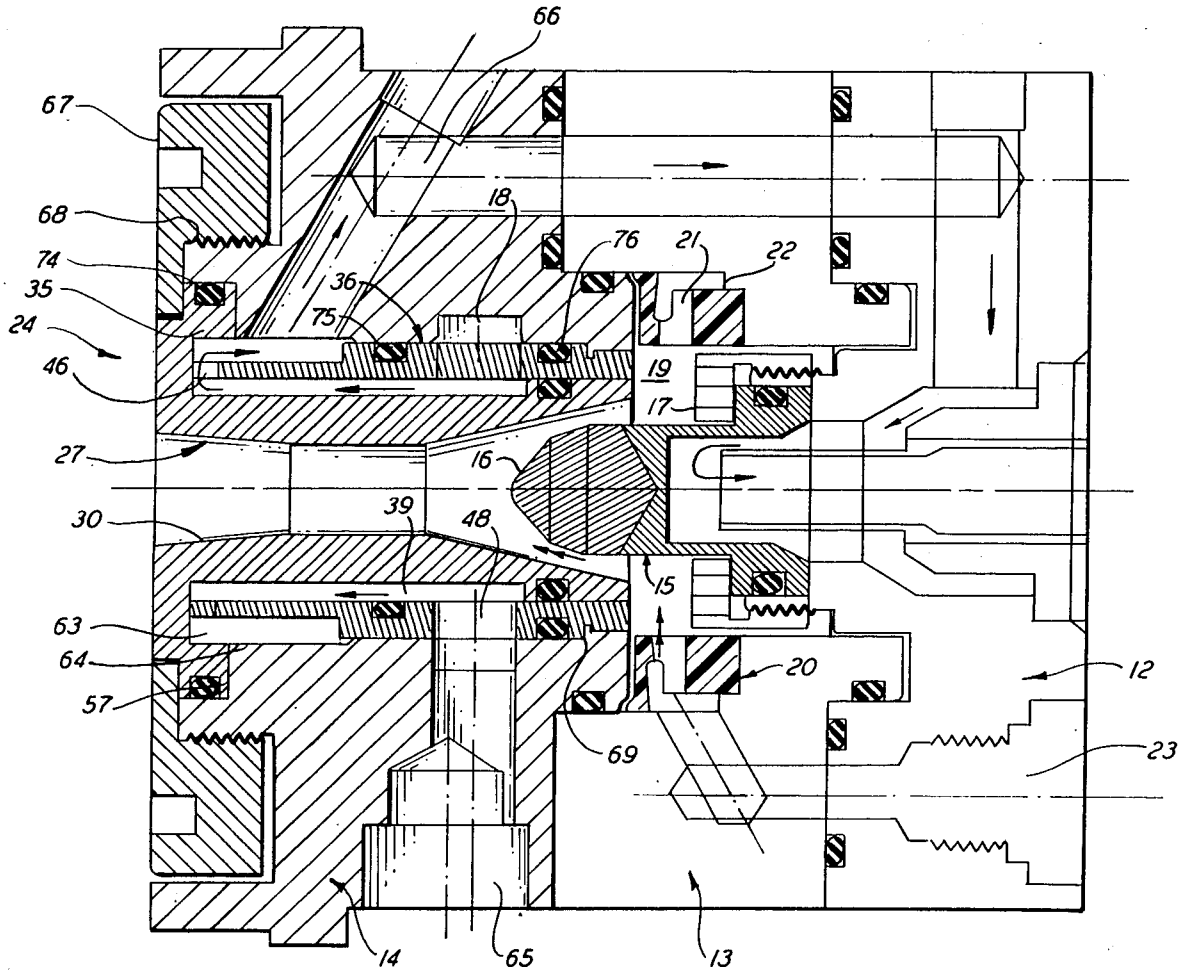
FIG. 1 is a longitudinal sectional view of a plasma gun incorporating the present invention.

FIG. 1 shows a cross section of a plasma spray gun 10 incorporating the present invention. A gun body 11 is comprised of three components held by screws or bolts (not shown) in sandwich construction, namely a rear gun section 12, an intermediate electrical insulator section 13 and a front gun section 14. The rear and front gun sections are made of electrically conductive material such as brass, are electrically insulated from each other by section 13, and are connected respectively to the negative and positive terminals of an arc-forming power source (not shown).

Gun body sections 12 and 13 are of generally annular configuration and, assembled as described above in coaxial relationship, coact to define a cylindrical internal cavity 18 within which are disposed, also in coaxial relationship, a nozzle assembly 24 and an elongate, generally cylindrical cathode member 15.

Cathode member 15 is constructed of copper, except for a tungsten tip 16, and is mounted in electrical contact with the rear gun section 12, it is held in place with a threaded nut 17.

At its inner end, cavity 18 terminates in an annular region 19 coaxially disposed about cathode member 15 and adjoining the rearward end of nozzle assembly 24. A gas distribution ring 20 is positioned in annular region 19 and has one or more holes 21, preferably two holes as in FIG. 1, which extend radially or have a tangential component for dispersing plasma-forming gas into annular region 19. Plasma-forming gas is introduced into the holes 21 via an annular groove 22 encircling the distribution ring 20, the groove 22 in turn being fed gas from gas inlet conduit 23 connected to a gas source (not shown).

Figure 2:
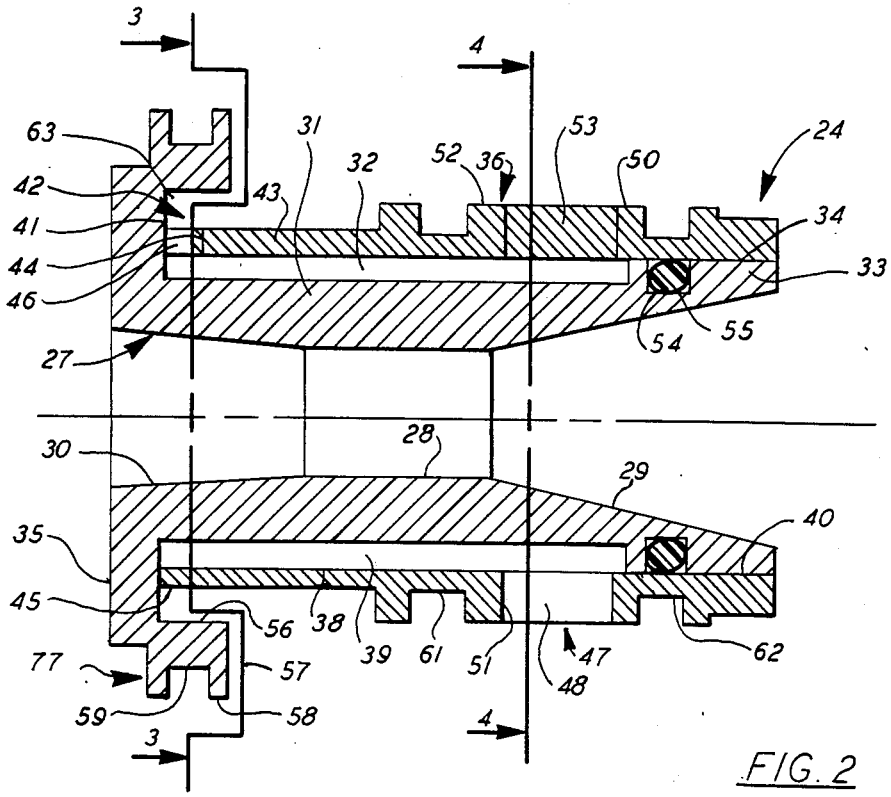
FIG. 2 is a longitudinal sectional view of a nozzle assembly of the present invention incorporated in FIG. 1.

Nozzle assembly 24, shown per se in FIG. 2, consists of a tubular anode nozzle member 27 and a coaxial jacket 36; the assembly is a close fit in the cylindrical cavity 18 of the gun body and is insertable and removable from the front of gun 10. When in place, the nozzle assembly 24 is positioned coaxially within front section 14 of the gun body with O-ring seals 74, 75 and 76 (FIG. 1) disposed in respective grooves 59, 61 and 62 (FIG. 2). Nozzle member 27, preferably formed of copper, has a radial flange 35 on its forward end portion. (As used herein, terms "front", "forward" and terms derived therefrom or synonymous or analogous thereto, have reference to the direction in which the plasma flame issues from the gun; similarly "rearward" etc. denotes the opposite direction.)

The interior bore of nozzle member 27 is coaxial with cathode member 15 (FIG. 1) and has a mid-portion 28, preferably of constant diameter. The forward portion 30 of the bore may also be of constant diameter equal to the midportion 28 or may diverge in the forward direction as shown in FIGS. 1 and 2. The rear portion 29 of the bore diverges rearwardly and cooperates with cathode member 15 to sustain an arc in plasma-forming gas flowing through the nozzle member. The operative relative dimensions and spacing of the bore and electrode member for proper plasma gun operation are well known in the art.

Referring to FIG. 2, the nozzle member 27 has a generally cylindrical middle portion 31 having an exteriority 32 coaxial with the bore, and has a rear portion 33 having a cylindrical outer surface 34 located generally radially outward from the inlet (rearward) end 29.

A jacket 36 is positioned to generally surround the nozzle member 27, except for the flange 35, in a predetermined coaxial position. The jacket is of generally hollow configuration with a forward inside surface 38 cooperating with the cylindrical middle portion 31 of the nozzle member 27 to define an annular passage 39 for coolant. Desirably the forward inside surface 38 of jacket 36 and the exteriority 32 are of uniform diameters, forming an annular channel of uniform height preferably in the range of 0.76 mm to 1.27 mm (.0030 to .050 inches), for example 1.02 mm (0.040 inches), for the purposes of high coolant velocity and efficient cooling as given in U.S. Pat. No. 4,430,546.

At its rearward end, jacket 36 has an inner surface 40 cooperative with a cylindrical outer surface 34 of the rear portion 33 of the nozzle member 27 permitting the jacket to slidingly fit concentrically over the rear portion 33 of the nozzle member 27; thus the nozzle member is removable and replaceable from the jacket forward with respect to the jacket. The nozzle member is retained by the flange 35 from passing rearward of its normal position in the jacket.

Figure 4:
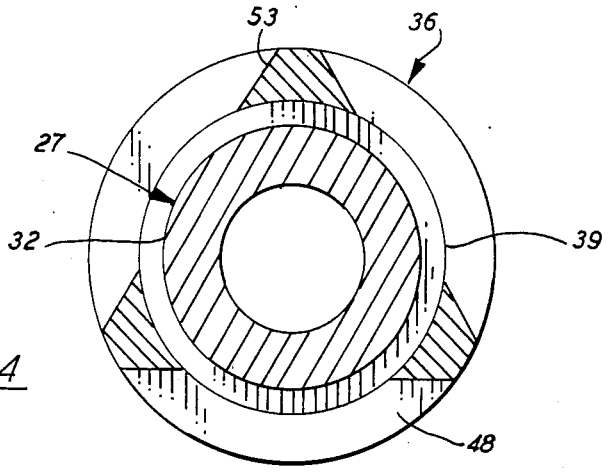
FIG. 4 is a transverse sectional view taken along section line 4—4 of FIG. 2.

A rear portal section 47 of jacket 36 contains a plurality of arcuate coolant ports 48 (3 are shown as appears in FIG. 4) equiangularly spaced about the circumference of the jacket. The ports are formed and separated by a like plurality of longitudinal struts or ribs 53 similarly spaced about the circumference of the jacket and extending between and integrating the rear portal section with the remainder of the jacket. Each of the ports 48 is in direct flow communication with annular coolant passage 39.

The arcuate configuration and circumferential elongation of the respective sets of ports 46 and 48 in communication with annular coolant passage 39 at its forward and rearward ends provide even radial distribution of coolant into and out of the chamber with minimum physical obstruction.

Figure 3:
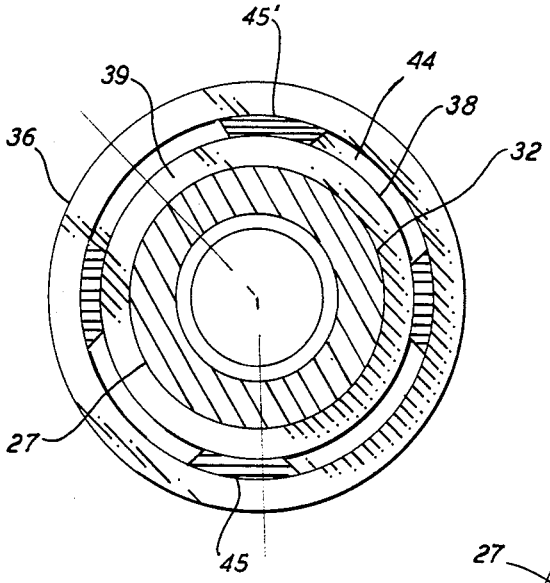
FIG. 3 is a transverse sectional view taken along section line 3—3 of FIG. 2.

Continuing with reference to FIG. 2, the nozzle flange 35 has a rearward-facing surface 41 coterminating with and extending radially outward from the exteriority 32. The forwardly facing end of jacket 36 has a plurality of equiangularly spaced projections 45 which engage the rearwardly-facing surface 41 of flange 35, limiting the rearward movement of nozzle member 27 into jacket 36 when the nozzle member is inserted into the jacket, thus establishing the relative axial positions of the members when assembled. The spaces between projections 45 define arcuate coolant ports 44 symmetrically spaced about the longitudinal axis of jacket 36 as best appears in FIG. 3. Preferably, projections 45 are four in number, defining four ports 44, as shown in FIG. 3. For clarity in FIG. 2 the upper projection 45' has been rotated out of view to depict coolant port 44.

A first seal to retain coolant is provided between the rear portion of the nozzle and the rear section of the jacket, capable of detachment for disassembling the nozzle assembly into its main components, the nozzle and jacket. Preferably the cylindrical outer surface 34 of the rear portion of the nozzle member 27 has an annular groove 54 therein with a standard O-ring seal 55 of rubber or the like. The cylindrical outer surface 34 should be of uniform diameter and generally the annular groove 54 should be in a maximum diameter section of the cylindrical outer surface. Cylindrical outer surface 34 has a radius that is slightly less than the radius of forward inside surface 38, being less only by an amount required for sliding clearance of jacket 36 over the nozzle member, that amount being taken up by the compressed O-ring. The width of annular passage 39 is the difference between the radius of forward inside surface 38 and the radius of exteriority 32; said width should be between 0.76 mm and 1.27 mm (0.030 inches and 0.050 inches). (Radius measurements are taken from the axis of nozzle assembly 24.)

In a preferred configuration radial flange 35 is formed with an integral circumferential rim 77 extending radially outward and axially rearward from the flange. Rim 77 has an outer circumferential surface 58 and an inner circumferential surface 56, the outer surface 58 containing annular groove 59 accommodating an O-ring seal 74, as previously mentioned (FIG. 1). Rim 77 and seal 74 coact with cylindrical cavity 18 of gun body 11 to position nozzle member 27 and seal against leakage of the coolant.

The rearward-facing radial surface 41 of flange 35 is bounded outwardly by the cylindrical surface 56 at a diameter approximately the same as or greater than the outside diameter of surface 52 of the jacket 36. Cylindrical surface 56 preferably extends rearward a distance between approximately half of and equal to the radial separation between the cylindrical middle portion 31 of the nozzle member 27 and the inward-facing surface 56 that the rearward-facing inner surface 41 and the inward facing surface 56 cooperate to form an annular channel 63 for the coolant. The rearward-facing outer wall 57 coterminates with and extends radially outward from the cylindrical wall 56 to coterminate with the outward-facing surface 58 of the rim. As shown in FIG. 1 this annular channel 63 has the same outer diameter as the section of the inner surface 64 of the cylindrical cavity 18 of the gun body 11 that extends rearward from the flange 35, thus creating a rearward extension of annular channel 63 for the coolant.

As indicated in FIG. 1, coolant such as water under pressure from a source (not shown) flows via an inlet channel 65 through the first set of coolant ports 48, along the annular passage 39 to cool the nozzle member 27, out the second set of coolant ports 46, thence through the annular channel 63 and out an exit channel 66. It then is routed to cool the cathode member 15 in the standard manner before it exits the gun.

With continued reference to FIG. 1, annular shoulder 69, on the outer surface of jacket 36 adjacent its inner (rearward) end seats adjacent a complementary shoulder on the inner surface of body section 14 when the nozzle assembly is in place. A retainer ring 67 making a threaded joint 68 on the front of gun section 14 holds the nozzle assembly in abutment with shoulder 69.

Jacket 36 may be made of any convenient material such as brass but is preferably made of electrically insulating material such as a machinable ceramic or a plastic. An insulating jacket prevents cross arcing to the gun body should the wall of the nozzle member 27 fail. It also has been found that an insulating jacket in the nozzle assembly, combined with electrical contact of the anode/nozzle only through flange 35 results in a desirably higher voltage such as an increase of 11 volts during operation. The benefits of higher voltage are further improvement in nozzle life as well as increased electrical efficiency of the arc. It is speculated that electrical contact at the flange directs the current toward the forward part of the nozzle member so as to encourage a longer arc, reflected as higher voltage.

The nozzle assembly according to the invention yields a structure for efficiently cooling the nozzle giving it longer life, while providing a convenient means for removing and replacing the nozzle in a plasma spray gun for routine maintenance or when the nozzle becomes excessively eroded from the arc. The assembly may be removed from the gun body as a unit, and the jacket 36 readily removed from the nozzle member 27, which is then replaced and the procedure reversed. Alternatively, the jacket may remain in place in the gun body and the nozzle alone removed and replaced. Either method provides a low cost gun construction and economical maintenance. Also, the ease of replacement makes it feasible to interchange nozzle members having different bore dimensions according to requirements for gun operation, while utilizing the same jacket. All nozzle members will have the same external dimensions.

Generally the nozzle wall thickness between the bore and the exteriority of the middle section should be in the range of 1.27 mm to 4.45 mm (0.050 to 0.175 inches) but may vary from this range in the region of diverging inlet and exit ends. A preferable nozzle member with a 5.54 mm (0.218 inch) diameter bore has a wall thickness between 1.73 mm and 3.58 mm (0.068 and 0.141 inches).

The nozzle assembly of the present invention is especially suited for a low cost gun, particularly for operation at low to medium power levels, providing simplified construction and easier replacement of nozzle members. Simultaneously there is provided longer nozzle life, improved efficiency, reliable operation and lower cost maintenance.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A nozzle assembly for fitting into the body of a plasma gun, comprising:

(a) a generally tubular nozzle member comprising a rear portion with a cylindrical outer surface, a forward portion with a flange extending radially outward therefrom and, therebetween, a middle portion having a cylindrical exteriority;

(b) a coolant jacket of generally hollow cylindrical configuration, disposed in a predetermined coaxial position about the nozzle member, comprising:

a cylindrical central section with an inside surface cooperating with the cylindrical exteriority of the nozzle member to define an annular coolant passage, the central section having a forward outside surface;

a cylindrical rear section with a rear inside surface;

a rear portal section disposed between the central section and the rear section, having one or more first coolant ports communicating with the annular passage, the rear portal section further having a rear outside surface and comprising a first wall bounded by the rear outside surface and the rear inside surface, a second wall bounded by the forward outside surface and the forward inside surface, and a plurality of struts connecting the first wall and the second wall such that the first and second walls and the struts coopperate to define the first coolant ports; and a forward portal section disposed between the central section and the nozzle member flange, providing one or more second coolant ports communicating with the annular passage;

the jacket and nozzle member being in relative axially slidable relationship for removal and replacement of the nozzle member forwardly with respect to the jacket, with the flange and the forward portal section cooperating to retain the nozzle member against rearward displacement from the predetermined postion relative to the jacket; and (c) a first detachable means for sealing to retain coolant, interposed between the outer surface of the rear portion of the nozzle member and the inside surface of the rear section of the jacket.

2. The nozzle assembly of claim 1 wherein:

the flange of the nozzle member comprises an inner face facing generally rearward, the inner face coterminating with and extending radially outward from the exteriority of the middle portion; and the forward portal section of the jacket comprises a ring section adjacent to the central section and terminating in a forward edge, and further comprises one or more projections extending forward from the forward edge to contact the inner surface of the flange so as to position the jacket axially with respect to the nozzle member, such that the inner face of the flange, the forward edge of the ring section and the projections cooperate to define one or more second coolant ports.

3. The nozzle assembly of claim 1 wherein the first detachable sealing means comprises the outer surface of the rear portion of the nozzle member having a first annular groove therein to receive a first O-ring seal.

4. The nozzle assembly of claim 1, further comprising second, third and fourth detachable means cooperative with the gun body for sealing to retain coolant, interposed between the gun body and, respectively, the nozzle flange, the cylindrical central section of the jacket and the cylindrical rear section of the jacket.

5. The nozzle assembly of claim 4 wherein:

the second detachable sealing means comprises a rim circumferentially bounding the flange, the rim having a second annular groove therein to receive a second O-ring seal;

the third detachable sealing means comprises a portion of the cylindrical central section of the jacket having a third annular groove therein to receive a third O-ring seal; and the fourth detachable sealing means comprises a portion of the cylindrical rear section of the jacket having a fourth annular groove therein to receive a fourth O-ring seal.

6. The nozzle assembly of claim 1 wherein the jacket is formed of electrically insulating material.

7. The nozzle assembly of claim 6 wherein the annular passage has a width between about 0.76 mm and 1.27 mm.

8. A nozzle assembly for a plasma gun, which comprises:

(a) a generally tubular nozzle member comprising a rear portion with a cylindrical outer surface having a first annular groove therein to receive a first O-ring seal, a forward portion with a flange extending radially outward therefrom and, therebetween, a middle portion having a cylindrical exteriority;

the flange of the nozzle member comprising a rearwardly facing surface coterminating with and extending radially outward from the exteriority of the middle portion, the flange being bounded circumferentially by a rim having a second annular groove therein to receive a second O-ring seal; and (b) a jacket of generally hollow configuration, disposed in a predetermined coaxial position about the nozzle member, comprising:

a cylindrical central section with a forward outside surface having a third annular groove therein to receive a third O-ring seal;

a cylindrical rear section with a rear inside surface in sealing contact with the first O-ring seal of the nozzle member to retain coolant, and with a rear outside surface having a fourth annular groove therein to receive a fourth O-ring seal;

a rear portal section disposed between the central section and the rear section, comprising a first wall bounded by the rear outside surface and the rear inside surface, a second wall bounded by the forward outside surface and the inner forward inside surface, and a plurality of struts connecting the first wall and the second wall such that the first and second walls and the struts cooperate to define first coolant ports communicating with the annular passage; and a forward portal section disposed between the central section and the nozzle flange, comprising a ring section adjacent to the central section and terminating in a forward edge, and further comprising one or more projections extending forward from the forward edge to contact the rearwardly facing surface of the flange so as to position the jacket axially with respect to the nozzle member, such that the rearwardly facing surface of the flange, the forward edge of the ring section and the projections cooperate to define one or more second coolant ports communicating with the annular passage;

the jacket and nozzle member being in relative axial slidable relationship for removal and replacement of the nozzle member forwardly with respect to the jacket, with the flange and the projections cooperating to retain the nozzle member from sliding rearward from the predetermined position with respect to the jacket.

9. A plasma gun comprising a cathode member, a gun body in which the cathode member is mounted, the gun body having a cylindrical cavity therein coaxial with and terminating proximate to the cathode member, and a nozzle assembly closely fitted into the cylindrical cavity, the nozzle assembly comprising:

(a) a generally tubular nozzle member comprising a rear portion with a cylindrical outer surface, a forward portion with a flange extending radially outward therefrom and, therebetween, a middle portion having a cylindrical exteriority;

(b) a coolant jacket of generally hollow configuration, disposed in a predetermined coaxial position about the nozzle member, comprising:

a cylindrical central section with a forward inside surface cooperating with the cylindrical exteriority of the nozzle member to define an annular coolant passage, the central section having a forward outside surface;

a cylindrical rear section with a rear inside surface;

a rear portal section disposed between the central section and the rear section, having one or more first coolant ports communicating with the annular passage, the rear portal section further having a rear outside surface and comprising a first wall bounded by the rear outside surface and the rear inside surface, a second wall bounded by the forward outside surface and the forward inside surface, and a plurality of struts connecting the first wall and the second wall such that the first and second walls and the struts cooperate to define the first coolant ports; and a forward portal section disposed between the central section and the nozzle member flange, providing one or more second coolant ports communicating with the annular passage;

the jacket and nozzle member being in relative axial slidable relationship for removal and replacement of the nozzle member forwardly with respect to the jacket, with the flange and the forward portal section cooperating to retain the nozzle member from sliding rearward from the predetermined position with respect to the jacket; and (c) a first detachable means for sealing to retain coolant, interposed between the outer surface of the rear portion of the nozzle member and the inside surface of the rear section of the jacket.

* * * * *